US006498431B1

(12) United States Patent
Katayama et al.

(10) Patent No.: US 6,498,431 B1
(45) Date of Patent: Dec. 24, 2002

(54) DISPLAY PANEL

(75) Inventors: Takashi Katayama, Kawasaki (JP); Yasuhiko Kunii, Kawasaki (JP); Shigeto Kurogi, Kawasaki (JP); Hiroyuki Nakahara, Kawasaki (JP); Akira Otsuka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/659,775

(22) Filed: Sep. 11, 2000

Related U.S. Application Data

(63) Continuation of application No. PCT/JP99/01552, filed on Mar. 25, 1999.

(30) Foreign Application Priority Data

Mar. 31, 1998 (JP) ..... 10-085441

(51) Int. Cl.[7] ..... H01J 17/49
(52) U.S. Cl. ..... 313/582; 313/586
(58) Field of Search ..... 313/422, 495, 313/485, 466, 461, 582, 583, 584, 585, 586

(56) References Cited

U.S. PATENT DOCUMENTS 3,975,175 A * 8/1976 Foster et al. ..... 65/31
5,209,688 A * 5/1993 Nishikagi ..... 445/24
5,541,479 A * 7/1996 Nagakubo ..... 313/586
5,757,131 A * 5/1998 Tsuchiya ..... 313/582
6,072,276 A * 6/2000 Okajima ..... 313/581
6,140,768 A * 10/2000 Kim ..... 313/584
2001/0054871 A1 * 12/2001 Tadaki et al. ..... 313/586

FOREIGN PATENT DOCUMENTS

JP 63232238 * 9/1988 ..... 313/610

* cited by examiner

*Primary Examiner*—Nimeshkumar D. Patel
*Assistant Examiner*—Thelma Sheree Clove
(74) *Attorney, Agent, or Firm*—Staas & Halsey L.L.P.

(57) ABSTRACT

In a display panel, the luminance and contrast are improved by making a partition semitransparent, which is a constituent element adjacent to a light-emitting section. A visible light incident on the partition proceeds inside the partition while being attenuated at a constant rate. When an external light incident on the partition from the front side is reflected off the bottom surface of the partition and returns to the front side again, the external light reciprocates inside the partition. Since the external light is largely attenuated by the reciprocation, the partition seemingly functions as an optical absorber with respect to the external light. A light emitted by the light-emitting section can transmit through the partition and radiate to the outside from the front side.

15 Claims, 9 Drawing Sheets

Fig. 5

| | EXAMPLE 1 | EXAMPLE 2 | CONVENTIONAL ART 1 | CONVENTIONAL ART 2 |
|---|---|---|---|---|
| COLOR OF PARTITION | TRANSLUCENT | TRANSLUCENT | BLACK | WHITE |
| INTENSITY [cd/cm²] (RATIO) | 128 (1.31) | 111 (1.13) | 98 (1.00) | 112 (1.14) |
| DISCHARGE CURRENT [A] (RATIO) | 0.42 (1.08) | 0.39 (1.00) | 0.39 (1.00) | 0.39 (1.00) |
| LIGHT EMISSION EFFECIENCY [lm/W] (RATIO) | 0.67 (1.20) | 0.63 (1.13) | 0.56 (1.00) | 0.64 (1.14) |
| REFLECTIVITY OF EXTERNAL LIGHT | 17.77% | 18.10% | 18.87% | 24.55% |

DISPLAY PANEL

CROSS-REFERENCE TO RELATED APPLICATIONS

This continuing application is filed under 35 U.S.C. 111 (a), based upon International Application PCT/JP99/01552 filed Mar. 25, 1999, it being further noted that priority is based upon Japan Patent Application JP10-85441, filed Mar. 31, 1998.

BACKGROUND OF THE INVENTION

1. Field of the Invention

The present invention relates to a display panel that is a surface device having a plurality of light emitting portions. More specifically, the invention relates to a surface discharge type plasma display panel (PDP) having partitions for defining discharge gas spaces.

2. Background of the Related Art

As a television display device having a wide screen, a 42-inch surface discharging format AC type PDP is commercialized. In this surface discharging format, first and second main electrodes are arranged in parallel on the front or the back substrate (usually, a glass plate). The first and the second main electrodes become anodes and cathodes alternately in the AC drive that sustains the lighted state by utilizing wall charge (charge of the dielectric). In the surface discharging format, compared with another format in which the first and the second main electrodes are arranged to cross each other, a fluorescent layer for color display can be arranged on the other substrate that faces the substrate on which the main electrode pairs are arranged. Thus, deterioration of the fluorescent layer due to ion impact upon discharge can be reduced, and a long life can be achieved. A "reflection type" in which the fluorescent layer is formed on the back substrate is superior to a "transparent type" in which the fluorescent layer is formed on the front side substrate, concerning a light emission efficiency.

The surface discharging format PDP has partitions each of which is arranged for every column of a matrix display for defining the inner discharge space. The partition separates the discharge connection between neighboring columns, and the size (thickness) of the discharge space is defined. Normally, the partitions are formed on the substrate on which the fluorescent layer is formed. By providing partitions having height corresponding to the thickness of the discharge space on one of the substrates, the registration of a pair of substrates in an assembling process becomes easy compared with the case where partitions having height that is a half of the thickness of the discharge space on both the substrates, for example. In addition, fluorescent layer can be provided so as to cover not only the upper surface of the substrate but also the side face of the partitions, so that the light emitting area can be increased and the viewing angle can be widened.

In the production of PDPs, the material of each member is selected considering affinity with substrate. The above-mentioned partition is formed by burning glass paste that has a low melting point and is applied in a predetermined pattern. The paste layer is formed by using a screen printing method or by cutting out unnecessary portions of a uniform layer.

Conventionally, the partition is colored by mixing a black or a white organic pigment in glass frit that is a main material of the partition, so the partition is substantially opaque. When the partition is colored black, it can absorb visible light more so as to reflect external light less, resulting in good contrast of display. In contrast, if the partition is colored white, it can reflect visible light rays more, so that the light rays that are emitted by the fluorescent layer and are directed to the partition can be recycled to the surface of the fluorescent layer for display use.

However, if the partition is colored black, the light that is emitted by the fluorescent layer and enters the partition can be absorbed by the partition, so a loss of light is generated. If the partition is colored white, external light rays may be reflected by the partition so that the contrast may be reduced. Namely, it is difficult to improve both the contrast and the intensity in the conventional structure.

The object of the present invention is to provide a display panel in which both the intensity and the contrast are improved.

SUMMARY OF THE INVENTION

A first display panel according to the present invention is characterized in that partitions are translucent that are elements neighboring a light emitting portion. In addition, a second display panel is characterized in that the partition includes a first layer that is transparent or translucent and a second layer having a large absorption ratio for visible light, and the second layer is disposed at the back side of the first layer.

In the translucent structure, useful light rays that enter the partition (light rays emitted inside the panel) pass the partition and are directed to the front though they are attenuated at a predetermined ratio. In contrast, external light rays that enter the partition propagated inside the partition and are reflected by the bottom surface of the partition to be directed to the front after passing through the partition again.

Compared with the useful light rays emitted inside the panel, the external light rays pass through the partition twice before returning to the front side, so that the ratio of the attenuation of the external light rays due to the pass through the partition is larger than that of the useful light rays. If the reflectivity of the external light (ratio of intensities of the emitting external light and the entering external light) is desired to be 0.1, the transparency $\alpha$ in the optical path corresponding to the height of the partition should satisfy the following inequality (1).

$$\alpha^2 \times \beta \leqq 0.1 \quad (1)$$

Here, $\beta$ is the reflectivity of the under layer of the partition. In order to enhance the intensity of the display, transparency $\alpha$ is desired to be larger. If the reflectivity $\beta$ is decreased by coloring the under layer of the partition dark, the inequality (1) will be satisfied and the transparency $\alpha$ can be increased.

In the double layer structure, the useful light rays pass through the first layer and are directed to the front side. In contrast, the external light that enter the partition pass the first layer and enter the second layer to be absorbed by the second layer. If the refractive index of the first layer is selected to the value substantially the same as that of the second layer, undesired reflection at the interface between the first and the second layers so that the external light rays that return to the front can be eliminated substantially.

According to the present invention, since the absorption of the useful light rays in the partition and the reflection of the external light can be reduced, the intensity can be improved without reducing the contrast, or the contrast can be improved without reducing the intensity. The present invention can be applied preferably to a display panel of a matrix display format in which the partitions occupy a relatively large area in the front surface. However, the present invention can be also applied to a display panel of a segment display format in which specific characters and signs can be displayed. In addition, the format of the light emission is not limited. It can be a self emission format such as electric discharge in a gas and electroluminescence or back light format for LCD.

BRIEF DESCRIPTION OF THE DRAWINGS

FIG. 5 is a table of a measurement result of an intensity and a reflectivity of the external light rays.

DESCRIPTION OF THE PREFERRED EMBODIMENTS

Figure 1:
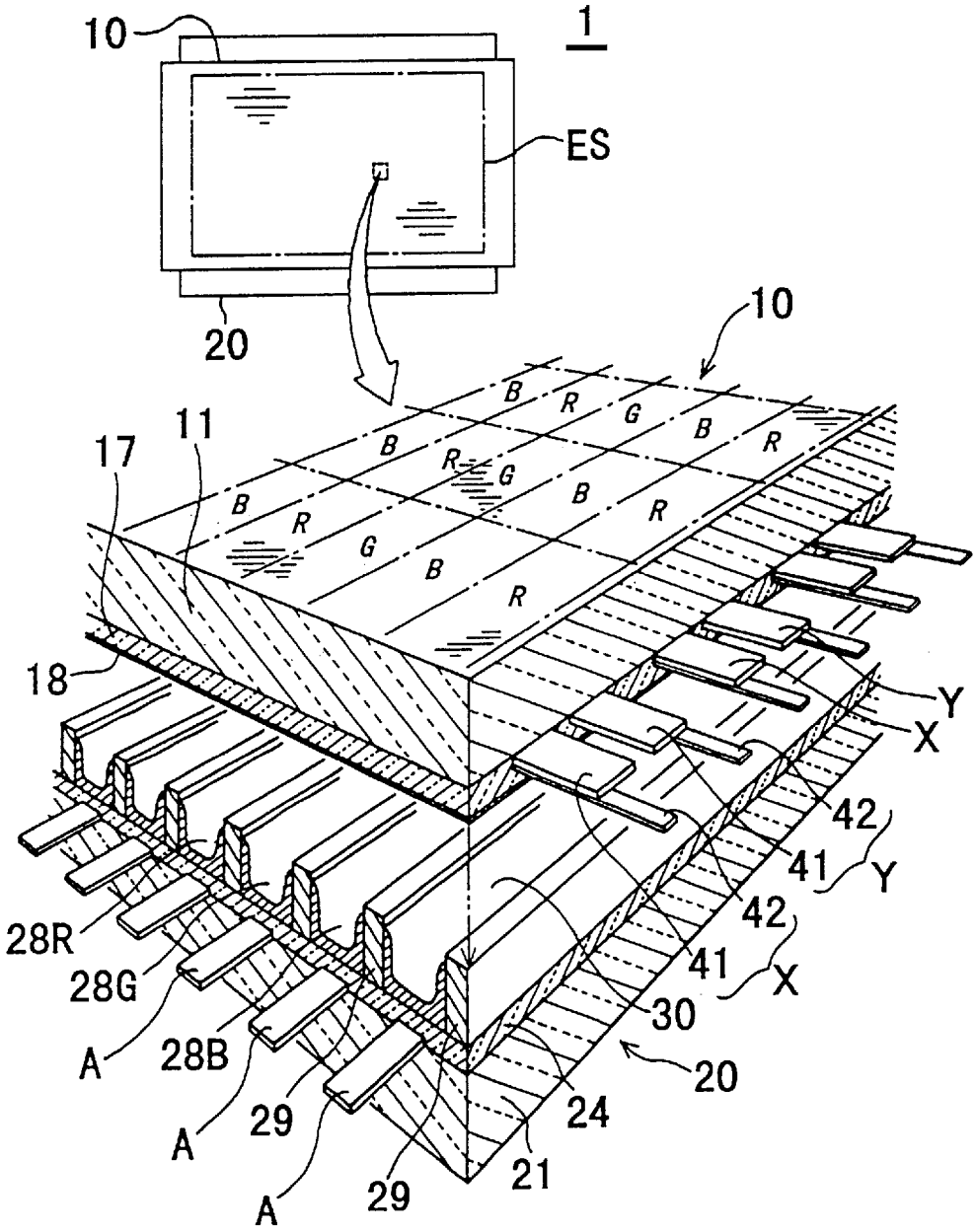
FIG. 1 is an exploded view showing an inner structure of a PDP according to the present invention.

As shown in FIG. 1, a PDP 1 is an AC type color PDP having three-electrode surface discharging structure of a screen ES that can perform matrix display and has a pair of substrate structures 10 and 20. The substrate structure means a structure including a plate-like support having a size wider than the screen and at least one kind of panel constituting element. In the assembling process for forming plural kinds of panel constituting elements on the substrate as the support sequentially, an in-process item that includes a substrate as a mail part in each step after forming the first panel constituting element is the substrate structure.

In each cell (display element) constituting the screen ES, a pair of sustain electrodes X and Y that are main electrodes and an address electrode A that is a third electrode cross each other. The sustain electrodes X and Y are arranged on the inner surface of the front glass substrate 11. Each of the sustain electrodes X and Y includes a transparent conductive film 41 and a metal film 42 for reducing a line resistance. A dielectric layer 17 is provided to cover the sustain electrodes X and Y and is made of a low melting point glass having a predetermined thickness (e.g., 30 $\mu$m). The surface of the dielectric layer 17 is coated with protection film 18 made of magnesia (MgO) that is superior in anti-spattering property and has a large secondary electron emission coefficient. The outer surface of the glass substrate 11 in the thickness direction is the front surface of the PDP 1

The address electrodes A are arranged on the inner surface of the back glass substrate 21 and are covered with a dielectric layer 24 having a thickness of approximately 10 $\mu$m. Translucent partitions 29 of the present invention are arranged at a regular pitch on the dielectric layer 24, and the discharge gas space 30 is divided in the row direction (the horizontal direction of the screen) for each cell by the partitions 29. Each partition 29 is formed by burning a low melting point glass paste layer and is a structure having a linear shape in the plan view and large aspect ratio (height/width) of the section. The outer surface of the glass substrate 21 in the thickness direction is the back surface of the PDP 1.

Figure 7:
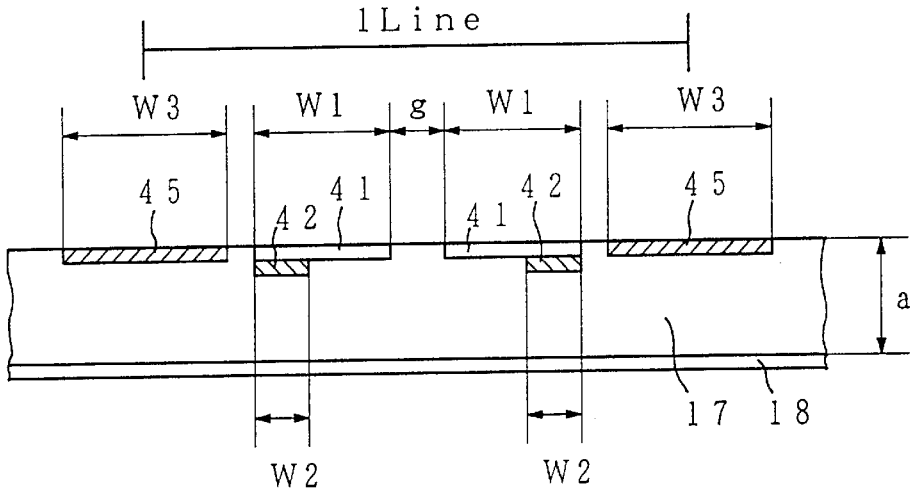
FIG. 7 is a schematic diagram of a main portion of the front substrate structure for illustrating an example of location condition of sustaining electrodes.

Red, green and blue fluorescent layers 28R, 28G and 28B for color display are arranged so as to cover the back inner surface including the upper portion of the address electrodes A and the side face of the partition 29, by one color for each column. Each of the fluorescent layers 28R, 28G and 28B corresponds to the light emitting portion of the present invention. One pixel of the matrix display includes three subpixels (unit of light emitting portion) arranged in the row direction, and the color of the emitted light of the subpixels is the same in the column direction that is the vertical direction of the screen. The structure within each of the subpixels is the cell. Since the arrangement pattern of the partition 29 is a stripe pattern, the portion corresponding to each column of the discharge gas space 30 is continuous in the column direction over all rows. Therefore, the fluorescent layers 28R, 28G and 28B that are uniform in the column direction can be formed simply by the screen printing, and the discharge gas can be filled quickly. In order to prevent discharge connection between neighboring cells in the column direction, the main electrode space is set to a sufficiently large value, and a band-like light shielding layer 45 (see FIG. 7) constituting a so-called black stripe is provided. The discharge gas is a penning gas containing neon as a main component and xenon, and the gas pressure is approximately 500 torr.

The PDP 1 uses the address electrodes A and the sustain electrodes Y for selecting (addressing) lighted (emitting) state or non-lighted state of each cell. Namely, n (number of rows) of sustain electrodes Y are supplied with a scan pulse one by one for screen scanning, and a predetermined charged state is formed in each row by address discharge between the sustain electrode Y and the address electrode A selected in accordance with the display contents. After the addressing, a sustain pulse having a predetermined peak value is supplied to the sustain electrodes X and the sustain electrodes Y alternately, a surface discharge is generated along the surface of the substrate in cells having an appropriated wall charge at the end of the addressing. The fluorescent layers 28R, 28G and 28B are excited locally to emit light by ultraviolet rays emitted by the discharge gas upon the surface discharging. A part of the visible light emitted by the fluorescent layers 28R, 28G and 28B passes through the glass substrate 11 and contributes to the display.

Next, the optical characteristics of the partition 29 will be explained.

As shown in FIG. 2(A), in the fluorescent layer of each color (e.g., a fluorescent layer 28R), the light emission is generated mainly at the surface. The light rays L11 that are generated at the surface and are directed to the discharge gas space neighboring to the surface are directed to the front (upper side in the figure) as display light. Some light rays generated at the surface are directed to the back side of the layer. There are also some light rays generated at the back side of the fluorescent layer 28R. In any way, the light rays L12 directed to the front surface among the light rays that enter the partition 29 from the fluorescent layer 28R become display light after passing through the partition 29 having a predetermined extent of light transparency. When passing through the partition 29, the light rays L12 are absorbed in some extent and the intensity of the light is attenuated. However, the attenuation quantity is small if the distance of passing through the partition 29 is short. In addition, in the structure in which the side of the partition 29 is covered with the fluorescent layer 28R, the light emission quantity is larger in the summit portion of the partition 29 (at the vicinity of the main electrode) than in the bottom portion. The light rays generated in the vicinity of the summit portion of the partition 29 passes through less distance of the partition 29 when being directed to the front side than the light rays generated in vicinity of the bottom portion. Namely, the ratio of the light rays absorbed by the partition 29 to the whole quantity of the light rays L11 and L12 emitted by the fluorescent layer 28R is small.

As shown in FIG. 2(B), when external light rays L21 enter the partition 29 from the front side (the upper side in the figure) perpendicularly or by the angle almost 90 degrees, the external light rays L21 propagate inside the translucent partition 29 having a predetermined absorbency with being attenuated and are directed to the back side (the lower side in the figure). The external light rays L21' that reach the bottom of the partition 29 are directed to the back side partly as the external light rays L22 and other part, i.e., the external light rays L23 are reflected by the bottom of the partition 29. The reflected external light rays L23 propagate inside the partition 29 with being attenuated and being directed to the front side. In this way, the external light rays L21 pass through the partition 29 by the distance twice the height h of the partition 29. The height h is 140 $\mu$m, for example. Therefore, even if the transmittance per a unit length is relatively large (i.e., the absorbance coefficient is small), the undesired external light rays L23' that causes reduction of the contrast can be reduced sufficiently. Namely, the contrast can be improved by attenuating the external light rays L21 inside the partition 29 without reflecting them by the upper surface of the partition 29 or the vicinity thereof. The larger the aspect ratio of the section of the partition, the larger the transparency of the partition becomes. As a result, the loss of the useful light is reduced and the reflection of the external light can be reduced sufficiently.

The reflectivity of the partition 29 can be reduced by the following method (a) and (b).

(a) A glass having a softening point lower than the PbO system parent glass that is a main component by approximately 10–100° C. is mixed in the paste of the partition material at a ratio of approximately 2–3 wt %. In the formation of the partition 29, even if the burning temperature is set lower than the softening point of the main component by several tens ° C. so as to maintain the three-dimension shape, the gap between the grains of the parent glass is filled with the low softening point glass, so that the refraction or the reflection at the interface of the parent glass grain and the air (i.e., light diffusion inside the partition) can be minimized.

(b) As a filler for preventing flow in the burning step, a material (such as a silicon dioxide, $SiO_2$) having a transparency larger than usual ceramics (such as a zirconium oxide, ZrO) and a refractive index that is substantially the same as that of the parent glass is mixed at the ratio of 5–30 wt%.

The glass material used for forming the translucent partition 29 that realized the object of the present invention includes a first and a second glass frit.

The first glass frit includes the lead mono oxide (PbO) as a main component at the ratio of 65–70 weight %, the diboron trioxide ($B_2O_3$) at the ratio of 5–10 weight %, the silicon dioxide ($SiO_2$) at the ratio of 20–25 weight % and the calcium oxide (CaO) at the ratio of 5–10 weight %. The softening point of the first glass frit is 565° C.

The second glass frit includes the lead mono oxide at the ratio of 60–65 weight %, the diboron trioxide at the ratio of 5–10 weight %, the silicon dioxide at the ratio of 20–25 weight %, and the calcium oxide at the ratio of 5–10 weight %. The softening point of the second glass frit is 575° C.

Figure 3:
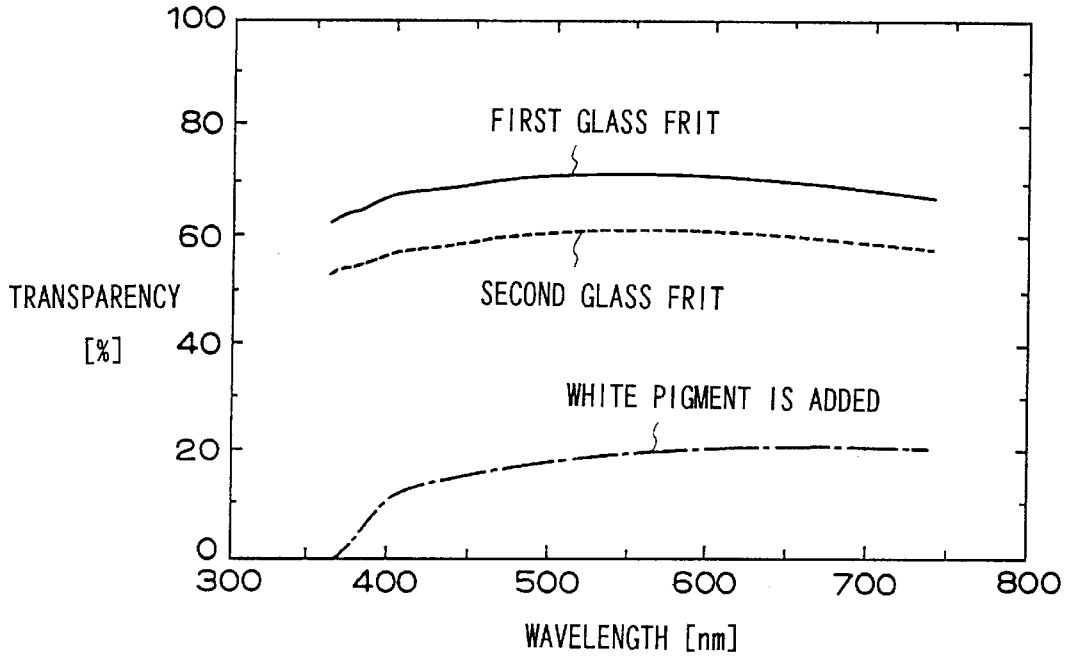
FIG. 3 is a graph of transparency characteristics of a glass layer according to the present invention.
Figure 4:
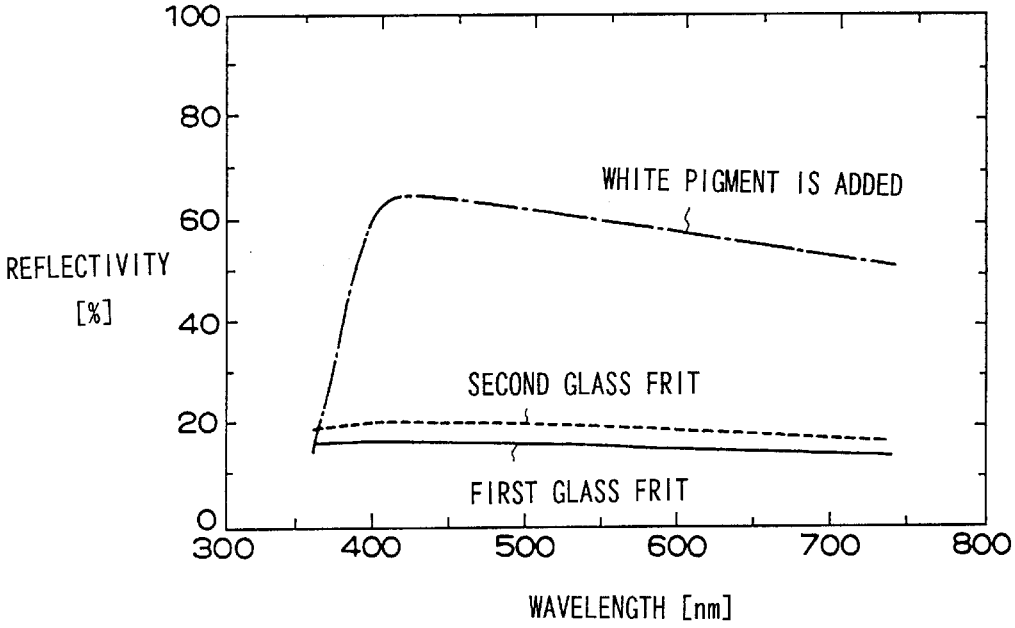
FIG. 4 is a graph of reflection characteristics of a glass layer according to the present invention.

The paste that is a mixture of the first glass frit or the second glass frit, a solvent (20 weight %) and a resin binder (1 weight %) is printed and is dried appropriately. After that, it is burnt at the temperature that is close to the softening point, so that the partition 29 can be obtained. FIG. 3 shows the result of the measurement of the transparency after forming a glass layer having the area more than one inch square under the condition similar to that of the partition formation. Such a measurement is performed because that a minute partition 29 is difficult to measure the transparency precisely. In FIG. 3, characteristics of the glass layer corresponding to the conventional partition doped with a white pigment for comparison. As shown in FIG. 3, concerning the glass layer that is made of the first glass frit (the thickness of the film is 25.2 microns) and the glass layer that is made of the second glass frit (the thickness of the film is 25.3 microns), the transparency is approximately 50–75% over the whole range of wavelength of 400–740 nanometers. In addition, FIG. 4 shows the result of the measurement of the reflectivity of the glass layer that is used for the measurement of FIG. 3. Concerning the glass layer that is made of the first or the second glass frit, the reflectivity is substantially constant and less than 20% over the whole range of wavelength of 400–740 nanometers.

FIG. 5 shows the result of measurement of the intensity of the white light emission and the reflectivity of the PDP 1 according to the present invention for the white external light along with the result of the measurement of a comparison example in the table format (The size specification of the PDP used for the measurement and the drive condition of the intensity measurement will be described later). The intensity depends on the discharge current, which is affected by the small difference of cell structure. Therefore, the table shown in FIG. 5 has an evaluation item of intensity, i.e., the light emission efficiency. The reflectivity is a ratio of the reflected light quantity to the incident light quantity at the front face when external light rays (standard light C defined by CIE) are irradiated perpendicularly and uniformly at the area substantially larger than a cell of the front face with all cells being unlighted. The smaller this external light reflectivity, the better the contrast becomes.

As shown in FIG. 5, the light emission efficiency of the first example in which the translucent partition consisting of the first glass frit is 20% larger than that of the first conventional art in which the partition is colored black. It is also larger than that in the second conventional art in which the partition is colored white. The light emission efficiency in the second example in which the translucent partition consisting of the second glass frit is 13% larger than that of the first conventional art and substantially the same as the second conventional art. In contrast, concerning the comparison of the external light reflectivity, it is below 20% in both the first and the second example and is smaller than that of the first conventional art.

The specification of the PDP used for the measurement is as follows.

The screen size is 42 inches.

The number of pixels is 852×480 (VGA).

The number of subpixels is 2556×480.

The size of the subpixel is 1080 μm×390 μm.

The material of the front substrate is a soda lime glass.

The thickness of the front substrate is 3 mm.

Figure 6:
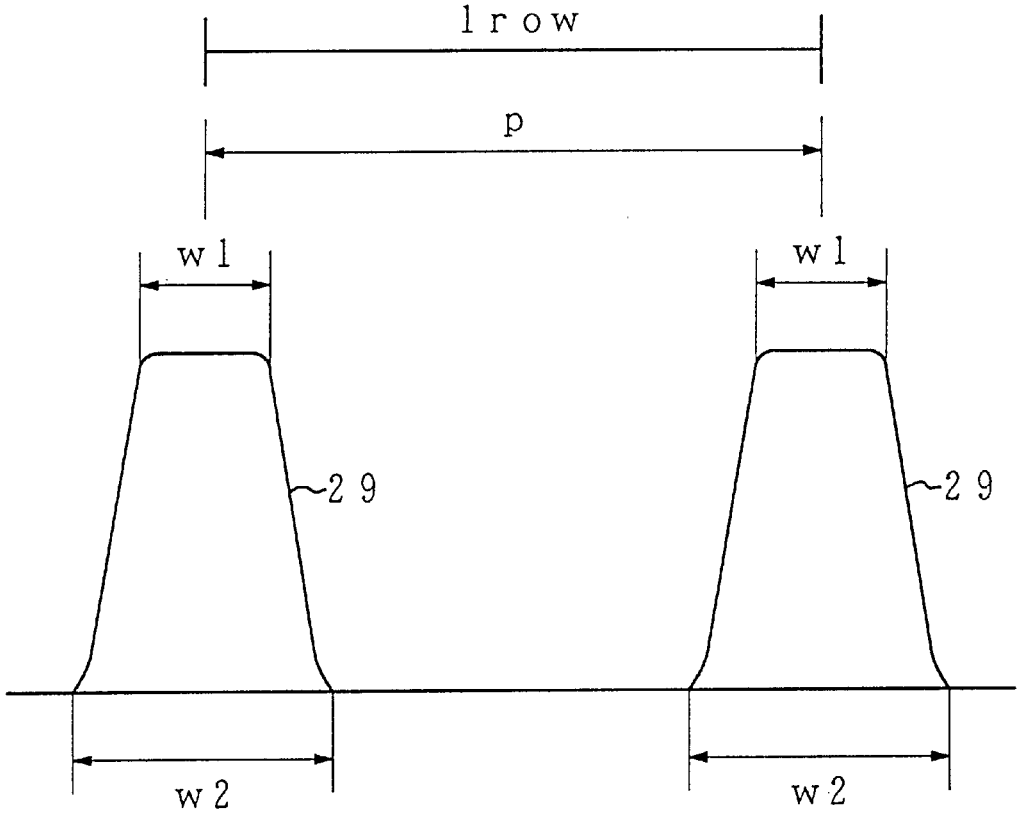
FIG. 6 is a schematic diagram of a section of a partition for illustrating an example of size condition of the partition location.

The width w1 of the upper portion of the partition (see FIG. 6) is 70 μm.

The width w2 of the bottom portion of the partition (see FIG. 6) is 140 μm.

The height h of the partition is 140 μm.

The arrangement pitch p of the partition (see FIG. 6) is 390 μm.

The width W1 of the main electrode (see FIG. 7) is 275 μm.

The width W2 of the metal film (see FIG. 7) is 100 μm.

The surface discharging gap g (see FIG. 7) is 100 μm.

The width W3 of the band-like light shielding layer between rows (see FIG. 7) is 350 μm.

The thickness a of the dielectric layer (see FIG. 7) is 30 μm.

The thickness a of the protection film is less than 1 μm.

Figure 8:
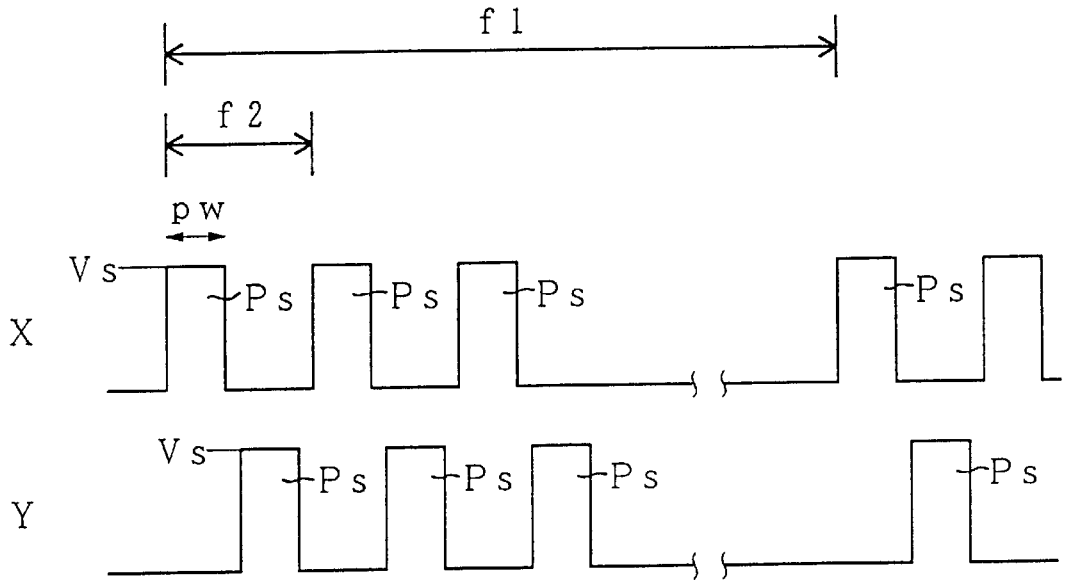
FIG. 8 illustrates voltage waveforms for showing condition for measuring the intensity.

In addition, the measurement of the intensity was performed in the sate where a voltage above the discharge starting voltage (300 volts) was applied to all cells so as to charge all cells uniformly, and then the sustaining pulse was applied to all main electrodes X and all main electrodes Y alternately and periodically. The intensity corresponds to an average light emission quantity in the period that is sufficiently longer than (more than a hundred times) the application period of the sustaining pulse (the period of the intermittent discharge). The condition of the sustaining pulse Ps (see FIG. 8) is as follows.

The peak value Vs (see FIG. 8) is 170 V.

The pulse width pw (see FIG. 8) is 4.0 μs.

The average frequency f1 (see FIG. 8) is 12.5 kHz.

The instant frequency f2 (see FIG. 8) is 109 kHz.

If the contrast is required to increase, a predetermined quantity of high absorption substance (Fine particles having a diameter of approximately several microns such as $Cr_2O_3$ or FeO) can be added to the low melting point glass paste that is a partition material, so that the transparency of the partition 29 is reduced. The ratio of the added substance is approximately 1–10 wt %. However, when the transparency is reduced, the intensity is reduced.

The partition 29 of the above-mentioned embodiment has a single layer structure. The single layer structure has an advantage in that man-hour in the production thereof is smaller than that of the multilayered structure and that scaling at the interface of layers does not occur. However, the single layer structure is not always required. In the PDP having the structure as shown in FIG. 1, the partition having the a multilayered structure as shown in FIG. 9(A) or 9(B) can be provided, so that the object of the present invention can be achieved.

Figure 9:
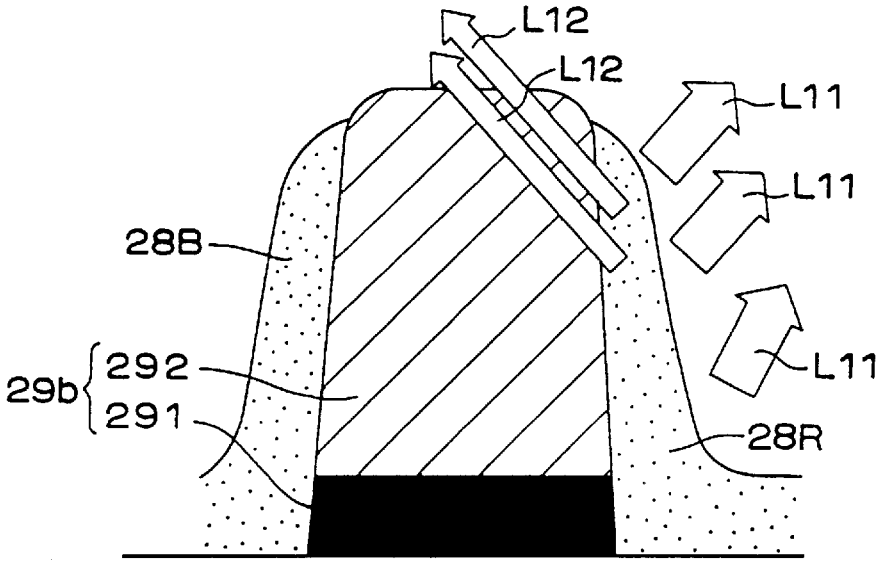
FIG. 9(A) is a schematic diagram of an action of a partition toward light that is emitted inside in a second embodiment.
FIG. 9(B) is a schematic diagram of an action of a partition toward external light in a second embodiment.
Figure 9:
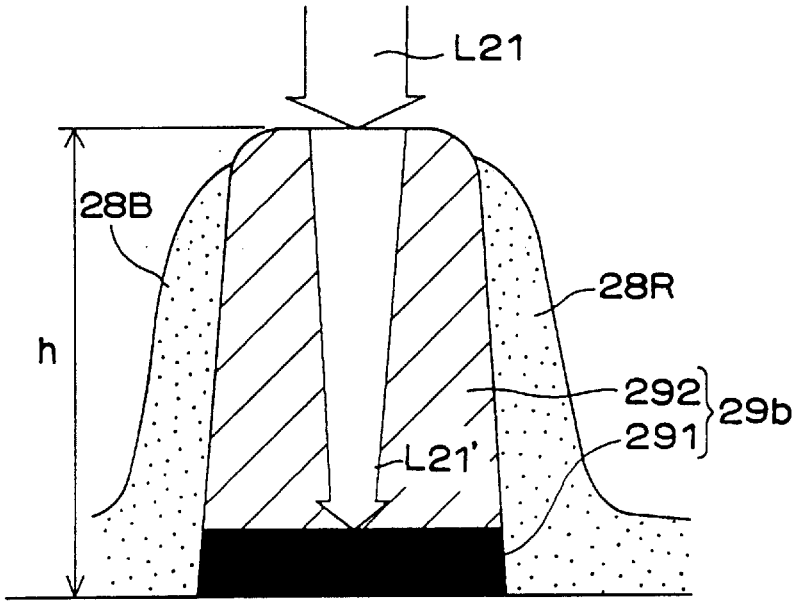

In FIG. 9(A), the partition 29*b* includes a dark colored under layer 291 and a transparent upper layer 292 that is laminated thereon. The right and left sides of the partition 29*b* are covered with fluorescent layers 28R and 28B from the bottom end to the upper end. The under layer 291 is a low melting point glass layer that is colored with a black pigment so as to have a high absorption ratio for light and has a role of absorbing the external light. The upper layer 292 is a transparent or translucent low melting point glass layer. It is desirable that the thickness of the under layer 291 is minimized within the range that can obtain sufficient effect of light absorption, and the practically preferred value of the thickness is approximately 5–10% of the height of the partition 29*b*.

Figure 2:
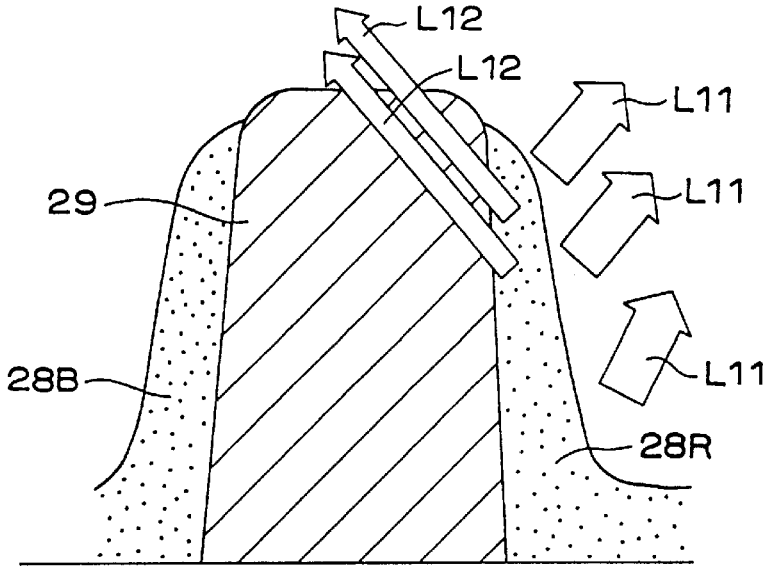
FIG. 2(A) is a schematic diagram of an action of a partition toward light that is emitted inside in a first embodiment.
FIG. 2(B) is a schematic diagram of an action of a partition toward external light in a first embodiment.
Figure 2:
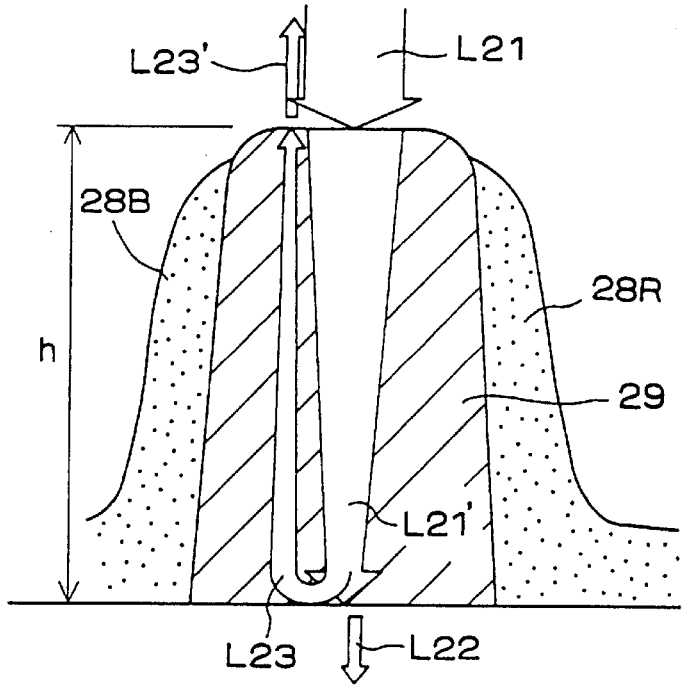

Concerning the partition 29*b*, the useful light emitted by the fluorescent layer 28R becomes display light in the same way as in the structure that is shown in FIG. 2. Namely, the light rays L11 that are generated in the vicinity of the surface of the fluorescent layer 28R and are emitted to the discharge gas space of the front side are directed to the front as a display light, and the light rays L12 directed to the front among the light rays that enter the partition 29 from the fluorescent layer 28R pass the partition 29*b* to be display light rays.

If the transparency of the upper layer 292 is increased by the above-mentioned method, the light rays generated by the fluorescent layer 28R can be used at most. However, even if the upper layer 292 is translucent, the light rays L12 can be used for the display since the attenuation of the light rays L12 that pass through the top portion of the partition 29*b* is little.

In contrast, if the external light L21 enters the partition 29*b* from the front side (the upper side in the figure) as shown in FIG. 9(B), the external light L21 passes through the upper layer 292 and is directed to the back side (the lower side in the figure). If there is little difference between the refractive index of the under layer 291 and that of the upper layer 292, the external light L21' after passing through the upper layer 292 is hardly reflected by the interface between the under layer 291 and the upper layer 292 so as to enter the under layer 291, which absorbs the external light L21'. If the upper layer 292 is translucent, since the attenuation of the light that passes through the upper layer 292 is not little, constraints of the absorption ratio (such as an additive quantity of the pigment or the thickness) that is required to the under layer 291 can be relieved and the layer forming becomes more flexible.

According to the multilayered structure, the items of setting about the optical characteristics include the transparency of the upper layer portion 292, the absorption ratio of the under layer portion 291 and the thickness of each portion. Since the number of items is lager than in the single layer structure, the flexibility of designing the partition 29*b* is increased. In addition, even if the height h of the partition 29*b* is small and the external light cannot be attenuated sufficiently by being translucent, the external light can be absorbed and the reflection can be prevented, resulting an improved contrast.

The partition pattern is not limited to the example that is shown in FIG. 1, i.e., a stripe pattern having linear partitions 29. It can be a stripe pattern having wave-like partition that meandering regularly or a mesh pattern that divides the screen into cells.

Availability in Industry

As the PDP mentioned above, the display panel according to the present invention has an advantage in that there is little loss in light emission and that reflection of external light is little, so that a bright screen with high contrast can be provided. Therefore, the present invention is useful for a matrix display and a segment display.

What is claimed is:

1. A display panel comprising:

a transparent front substrate;

a back substrate that opposes the front substrate;

partitions for dividing a space between the front and the back substrates; and a light emitting portion that is adjacent to the partitions, wherein each of the partitions is a translucent structure having transparence for passing light rays emitted by the light emitting portion and an absorbance for attenuating light rays entering the partition, and wherein each of the partitions is a structure made of a burned paste whose main component is a glass frit that contains 60–70 weight % of the lead mono oxide, 5–10 weight % of the diboron trioxide, 20–25 weight % of the silicon dioxide and 5–10 weight % of the calcium oxide.

2. A display panel comprising:

a transparent front substrate;

a back substrate that opposes the front substrate;

partitions for dividing a space between the front and the back substrates; and a light emitting portion that is adjacent to the partitions, wherein each of the partitions is a translucent structure having a transparence for passing light rays emitted by the light emitting portion and an absorbance for attenuating light rays entering the partition, and wherein each of the partitions is a structure made of a burned paste whose main component is a glass frit that contains 60–70 weight % of the lead mono oxide, 5–10 weight % of the diboron trioxide, 20–25 weight % of the silicon dioxide and 5–10 weight % of the calcium oxide, and the reflectivity of the visible light rays that enter the front substrate perpendicularly from the front side is less than 20%.

3. A display panel comprising:

a transparent front substrate;

a back substrate that opposes the front substrate;

partitions for dividing a space between the front and the back substrates; and a light emitting portion that is adjacent to the partitions, wherein each of the partitions is a translucent structure having a transparence for passing light rays emitted by the light emitting portion and an absorbance for attenuating light rays entering the partition, and wherein each of the partitions is a uniform single layer structure.

4. The display panel according to claim 3, wherein the reflectivity of the visible light rays that enter the front substrate perpendicularly from the front side is less than 20%.

5. The display panel according to claim 3, wherein each of the partitions is a structure made of a burned paste whose main component is a glass frit to which a substance that absorbs visible light rays is added.

6. A display panel comprising:

a transparent front substrate;

a back substrate that opposes the front substrate;

partitions for dividing a space between the front and the back substrates; and a light emitting portion that is adjacent to the partitions and emits light rays by electric discharge in a gas;

wherein each of the partitions is a translucent, structure having a transparence for passing light rays emitted by the light emitting portion and an absorbance for attenuating light rays entering the partition, and wherein each of the partitions is a uniform single layer structure.

7. The display panel according to claim 6, further comprising a screen that enables a matrix display, a plurality of electrodes constituting electrode pairs for generating surface discharge on the inner surface of the front substrate, wherein the partitions are band-like structures viewed from the top and are arranged so as to divide the space and define each column of the matrix display.

8. The display panel according to claim 6, wherein the dimension of each of the partitions in the height direction is longer than that in the row direction display panel.

9. The display panel according to claim 6, wherein the light emitting portion includes a gas space for emitting ultraviolet rays and a fluorescent layer that emits light rays being excited by the ultraviolet rays, and the fluorescent layer is arranged to cover the side face of each of the partitions.

10. The display panel according to claim 9, wherein the front substrate on which the electrodes are arranged and the back substrate on which the partitions and the fluorescent layer are arranged are made integrally.

11. The display panel according to claim 6, wherein each of the partitions is a structure made of a burned paste whose main component is a glass frit in which as transparent substance is added as an anti-fluid material.

12. A display panel comprising:

a transparent front substrate;

a back substrate that opposes the front substrate;

partitions for dividing a space between the front and the back substrates; and a light emitting portion that is adjacent to the partitions and emits light rays by electric discharge in a gas, and wherein each of the partitions is a translucent structure having a transparence for passing light rays emitted by the light emitting portion and an absorbance for attenuating light rays entering the partition, and wherein each of the partitions is a structure made of a burned paste whose main component is a glass frit that contains 60–70 weight % of the lead mono oxide, 5–10 weight % of the diboron trioxide, 20–25 weight % of the silicon dioxide and 5–10 weight % of the calcium oxide.

13. The display panel according to claim 6, wherein the reflectivity of the visible light rays that enter the front substrate perpendicularly from the front side is less than 20%.

14. A display panel comprising:

a transparent front substrate;

a back substrate that opposes the front substrate;

partitions for dividing a space between the, front and the back substrates; and a light emitting portion that is adjacent to the partitions and emits light rays by electric discharge in a gas, wherein each of the partitions is a translucent structure having a transparence for passing light rays emitted by the light emitting portion and an absorbance for attenuating light rays entering the partition, and wherein each of the partitions is a structure made of a burned paste whose main component is a glass frit that contains 60–70 weight % of the lead mono oxide, 5–10 weight % of the diboron trioxide, 20–25 weight % of the silicon dioxide and 5–10 weight % of the calcium oxide, and the reflectivity of the visible light rays that enter the front substrate perpendicularly from the front side of each of the partitions is less than 20%.

15. The display panel according to claim 6, wherein each of the partitions is a structure made of a burned paste whose main component is a glass frit to which a substance that absorbs visible light rays is added.

* * * * *

UNITED STATES PATENT AND TRADEMARK OFFICE

CERTIFICATE OF CORRECTION

PATENT NO. : 6,498,431 B1 
DATED : December 24, 2002
INVENTOR(S) : Takashi Katayama et al.

It is certified that error appears in the above-identified patent and that said Letters Patent is hereby corrected as shown below:

Title page,
Item [56], References Cited, FOREIGN PATENT DOCUMENTS, insert:

| | | |
|---|---|---|
| -- EP | 0722179 | 07/1996 |
| JP | 62-180853 | 11/1987 |
| JP | 61-24126 | 02/1986 |
| JP | 7-85797 | 03/1995 |
| JP | 7-192634 | 07/1995 |
| JP | 8/138559 | 05/1996 |
| JP | 9-55166 | 02/1997 |
| JP | 11-60273 | 03/1999 -- |

Signed and Sealed this

Sixteenth Day of December, 2003

JAMES E. ROGAN
*Director of the United States Patent and Trademark Office*